US011628319B2

(12) United States Patent
Hung et al.

(10) Patent No.: US 11,628,319 B2
(45) Date of Patent: Apr. 18, 2023

(54) FALL ARREST DEVICE

(71) Applicant: YOKE INDUSTRIAL CORP., Taichung (TW)

(72) Inventors: Wei-Chieh Hung, Taichung (TW); Wen-Ming Liao, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 120 days.

(21) Appl. No.: 17/186,590

(22) Filed: Feb. 26, 2021

(65) Prior Publication Data

US 2022/0273972 A1 Sep. 1, 2022

(51) Int. Cl.
*A62B 35/00* (2006.01)
*B65H 75/30* (2006.01)

(52) U.S. Cl.
CPC ..... *A62B 35/0093* (2013.01); *B65H 75/30* (2013.01)

(58) Field of Classification Search
CPC ..... A62B 35/00; A62B 35/0093; B65H 75/30
See application file for complete search history.

(56) References Cited

U.S. PATENT DOCUMENTS 3,760,910 A * 9/1973 Koshihara ..... F16D 59/00 182/237
4,520,998 A 6/1985 Flaig
6,279,682 B1 8/2001 Feathers
9,132,301 B2 * 9/2015 Jones ..... F16D 59/00
2009/0211848 A1 8/2009 Parker et al.
2012/0031701 A1 * 2/2012 Jones ..... A62B 35/0093 188/69
2012/0118670 A1 5/2012 Olson et al.
2016/0096048 A1 * 4/2016 Fegley ..... A62B 1/10 182/232

(Continued)

FOREIGN PATENT DOCUMENTS

CN 211357505 U 8/2020
CN 114306974 A 4/2022

(Continued)

OTHER PUBLICATIONS

Search report for TW109147102, dated Jun. 1, 2021, Total of 1 page.

(Continued)

*Primary Examiner* — Sang K Kim
(74) *Attorney, Agent, or Firm* — Apex Juris, PLLC; Tracy Heims; Hilde Coeckx

(57) ABSTRACT

A fall arrest device includes a braking device, a frame, and a rotating member connected to the frame. The rotating member includes a main body and a plurality of pawls which are pivotally connected to a mounting portion of the main body. Each of the pawls has an abutting portion, a pivot, and a body portion. The braking device has a plurality of abutted portions. When a rotation speed of the rotating member is greater than or equal to a predetermined rotation speed, the abutting portions abut against the abutted portions to stop a rotation of the rotating member. When the rotation speed of the rotating member is smaller than the predetermined rotation speed, the body portion of each of the pawls touches a periphery of the abutted portions and swings as an outer diameter of the abutted portions of the braking device changes.

7 Claims, 9 Drawing Sheets

(56) References Cited

U.S. PATENT DOCUMENTS

2018/0015312 A1* 1/2018 Jones ..... A62B 35/04

FOREIGN PATENT DOCUMENTS

| | | | |
|---|---|---|---|
| EP | 2771076 | B1 | 3/2018 |
| TW | M421128 | U | 1/2012 |
| TW | M612644 | U | 6/2021 |
| WO | 2016120614 | A1 | 8/2016 |

OTHER PUBLICATIONS

English abstract for TWM421128, Total of 1 page.
Search Report for CN202110016397.3, dated Sep. 26, 2022, Total of 2 pages.
Translation of Abstract of CN211357505, Total of 1 page.
Translation of Abstract of TWM612644, Total of 1 page.
Translation of Abstract of CN114306974, Total of 1 page.

* cited by examiner

FALL ARREST DEVICE

BACKGROUND OF THE INVENTION

Technical Field

The present invention relates generally to a fall arrest device, and more particularly to a fall arrest device having a dual locking system.

Description of Related Art

Nowadays, buildings are built higher and higher, so that the safety risks that a builder, a worker cleaning an exterior wall, and a worker painting the exterior wall takes are increased. Therefore, the worker who works at a high place needs to use a safety device equipped with a fall arrest device. By fixing the fall arrest device to a fixed place and tightening the safety belt connected to the fall arrest device to the worker, the fall arrest device could prevent the worker from falling from height and ensure the safety of the worker.

A conventional fall arrest device includes a rotating drum, a safety belt, and a braking device, wherein an end of the safety belt is connected to the rotating drum and winds around the rotating drum. The braking device includes a braking plate, a braking part, and a stopper. The braking plate connected to the rotating drum rotates simultaneously with the rotating drum. The braking part is pivotally connected to the braking plate, so that a centrifugal force generated when the braking plate rotates rapidly leads the braking part to swing outwardly to engage with the stopper, thereby stop a rotation of the rotating drum. When the worker working at height falls accidentally, the braking device could immediately lock to stop the rotation of the rotating drum, thereby preventing the worker from falling.

However, most of the conventional fall arrest devices only have one single set of braking parts. When the braking part is rotated to different positions (such as the highest point or the lowest point), a gravitational force of the braking part or resilience for pulling the braking part could offset the centrifugal force of the braking plate, so that the braking part is unable to engage with the stopper and the rotating drum could keep rotating to allow the worker to fall. In such a situation, the worker can still be hurt due to the fall.

Additionally, the worker usually works at a place full of dust. Dust easily adheres to the fall arrest device, especially to a pivot site of the braking part. The braking part may be unable to swing outwardly resulting from the pivot site of the braking part being stuck, so that the rotation of the rotating drum cannot be stopped in time.

To avoid the fall arrest device being affected by dust, a fall arrest device with a shell for isolating the dust is developed. However, the isolating effect of the shell is limited. The dust can adhere to the safety belt exposed outside, and the dust can enter into the shell when the safety belt outside is retracted back to the shell. After the dust enters into the shell, the dust can adhere to the pivot site of the braking part such that the braking part gets stuck.

BRIEF SUMMARY OF THE INVENTION

In view of the above, a primary objective of the present invention is to provide a fall arrest device, wherein a user could pull a safety belt of the fall arrest device before use, and oscillations of pawls caused by pivoting could inform the user that the pawls are not stuck and can function normally. The fall arrest device provided by the present invention includes a plurality of pawls. When the pawls rotate to the different positions, such as the highest point or the lowest point, a force that make the pawls tilt or the gravitational force of the body portion could be in the same direction with a centrifugal force. Either the force that makes the pawls tilt or the gravitational force of the body portion and the centrifugal force could jointly lead the pawls to tilt, so that each of the pawls could indeed engage the braking device to stop the rotation of the rotating member, thereby stopping or decelerating speed of falling to save the life of the user.

The present invention provides a fall arrest device including a frame, a rotating member, and a braking device. The frame has a first arm and a second arm. The rotating member is pivotally connected to the frame and located between the first arm and the second arm. The main body has a mounted portion and a receiving portion. The receiving portion is adapted to be winded up by a flexible long strip body. Each of the plurality of pawls has an abutting portion and a pivot, wherein the pawls are pivotally connected to the mounted portion via the pivot. When a rotation speed of the rotating member is greater than or equal to a predetermined rotation speed, the abutting portions of the pawls pivot from a first position to a second position. When the pawls are in the second position and rotate as the rotating member rotates, the abutting portions of the pawls move along a rotational pathway. When the pawls are in the second position and rotate as the rotating member rotates, the abutting portions of the pawls move along a rotational pathway. The braking device has a protrusion and is engaged with the first arm via the protrusion, wherein the braking device is located between the first arm and the mounted portion of the rotating member. The braking device further includes a plurality of abutted portions which are disposed on the rotational pathway of the abutting portions in the second position, so that the abutted portions could be abutted by the abutting portion to stop a rotation of the rotating member. Each of the pawls further includes a body portion which is located at a side of the pivot, and the abutting portion is located at another side of the pivot which is opposite to the side with the body portion. When the rotation speed of the rotating member is smaller than the predetermined rotation speed, the body portion of each of the pawls touches a portion of a periphery of the plurality of abutted portions and swings as an outer diameter of the abutted portion of the braking device changes.

With the aforementioned design, the user could pull the safety belt of the fall arrest device before use, and the oscillations of the pawls caused by pivoting could inform the user that the pawls are not stuck and could function normally. The fall arrest device provided by the present invention includes the plurality of pawls. When the pawls rotate to the different positions, such as the highest point or the lowest point, the force that make the pawls tilt or the gravitational force of the body portion and the centrifugal force. Either the force that makes the pawls tilt or the gravitational force of the body portion and the centrifugal force could jointly lead the pawls to tilt, so that each of the pawls could indeed engage the braking device to stop the rotation of the rotating member, thereby stopping or decelerating speed of falling to save the life of the user.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
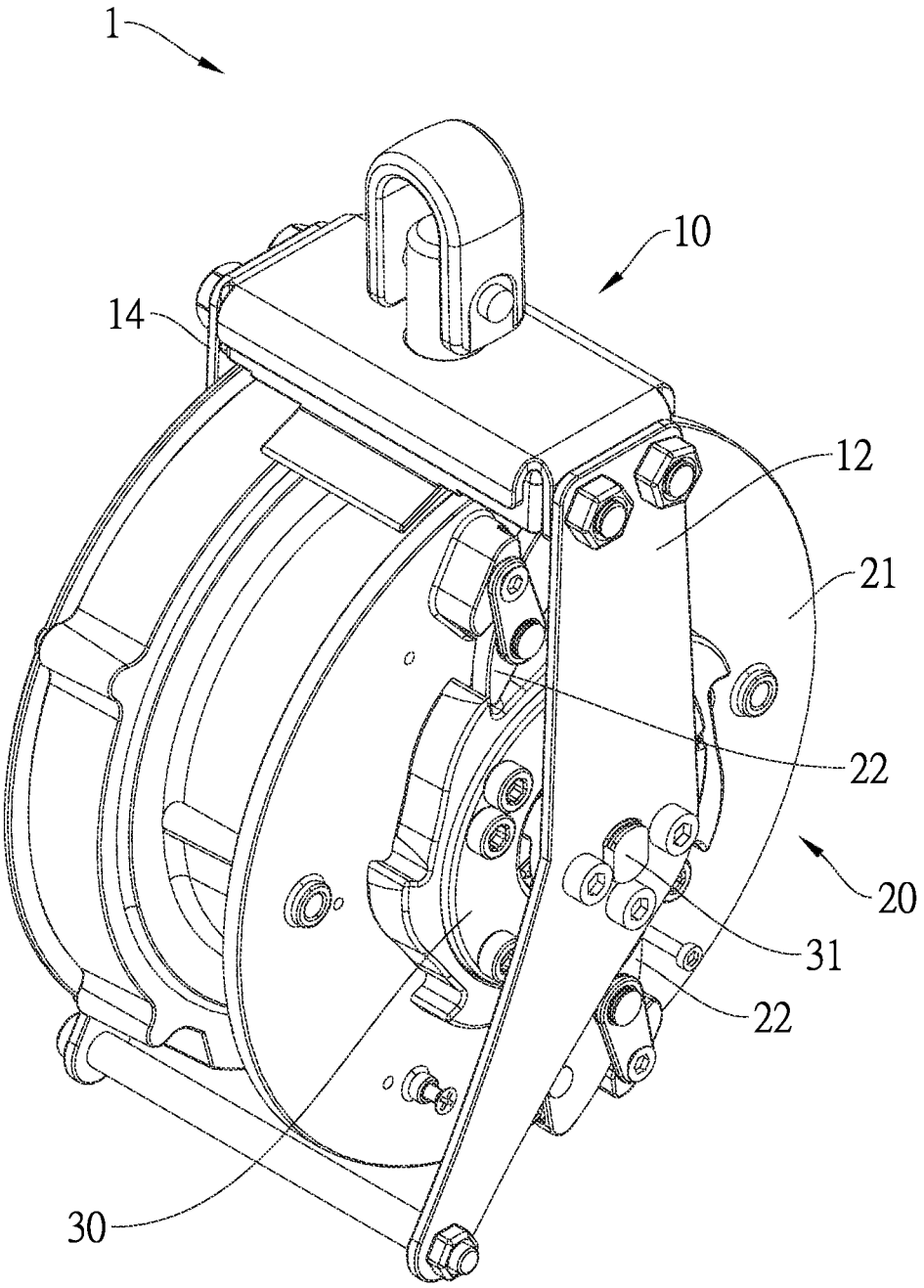
FIG. 1 is a perspective view of the fall arrest device of an embodiment according to the present invention.
Figure 2:
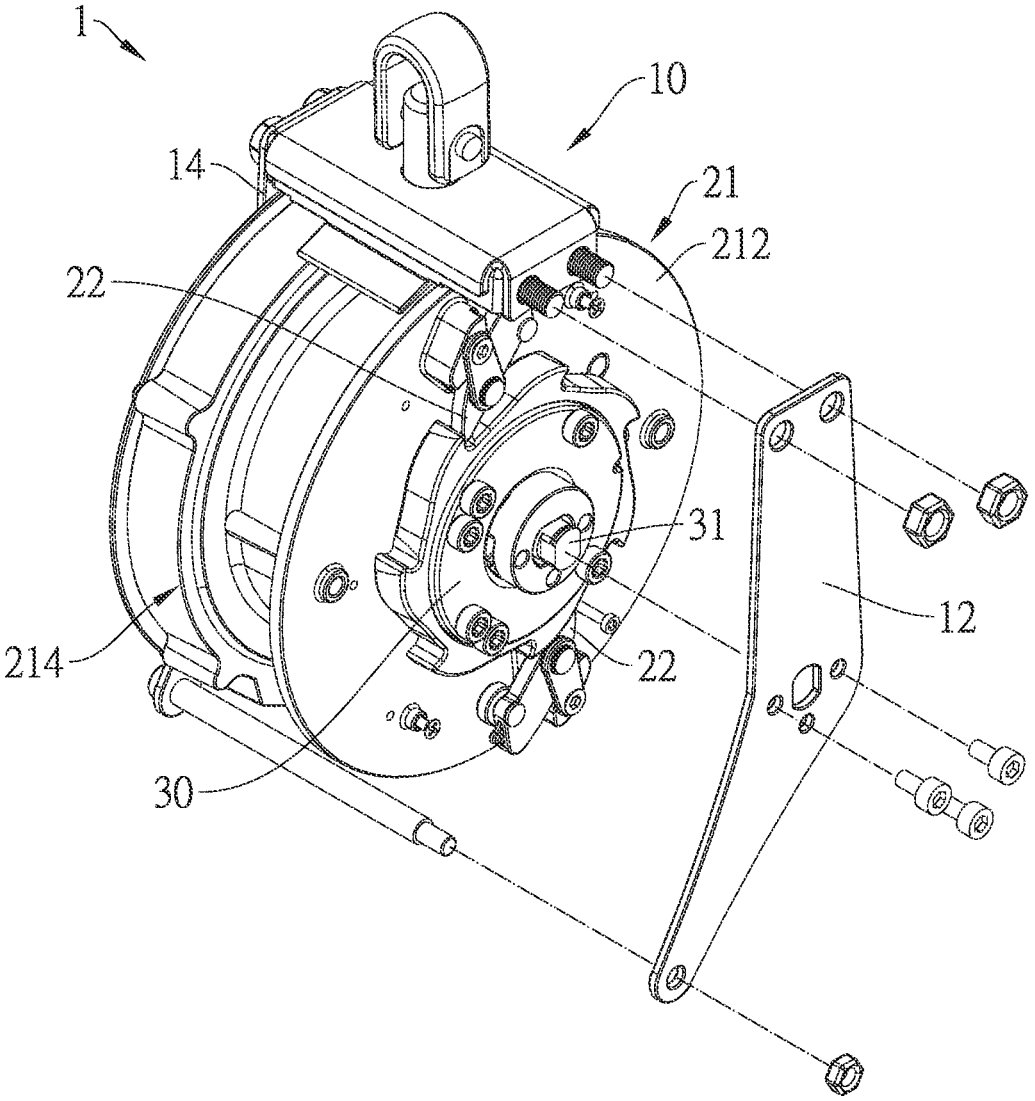
FIG. 2 is a partially exploded view of the fall arrest device shown in FIG. 1.
Figure 3:
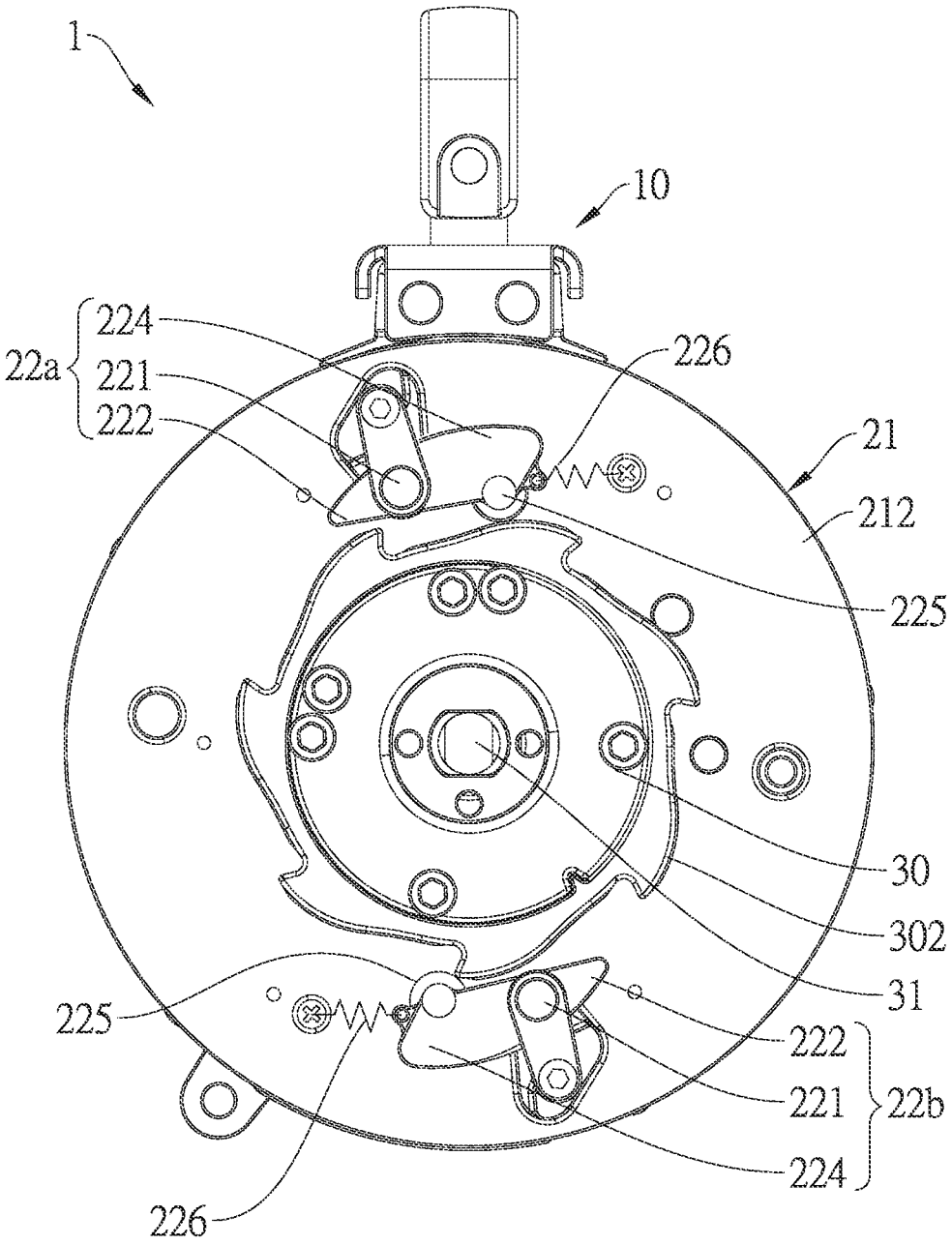
FIG. 3 is a front view of the fall arrest device of the embodiment according to the present invention, wherein the first arm of the frame is omitted.

Referring to FIG. 1 to FIG. 3, FIG. 1 is a perspective view of a fall arrest device 1 of an embodiment according to the present invention; FIG. 2 is a partially exploded view of the fall arrest device 1 shown in FIG. 1; FIG. 3 is a front view of the fall arrest device 1 of the embodiment according to the present invention, wherein a first arm 12 of a frame 10 is removed. As illustrated in FIG. 1 to FIG. 3, the fall arrest device 1 includes the frame 10, a rotating member 20, and a braking device 30.

The frame 10 has the first arm 12 and a second arm 14. The rotating member 20 is pivotally connected to the frame 10 and is located between the first arm 12 and the second arm 14.

The rotating member 20 includes a main body 21 and a plurality of pawls 22, wherein the main body 21 has a mounted portion 212 and a receiving portion 214. The receiving portion 214 is adapted to be winded up by a flexible long strip body (not shown). Each of the plurality of pawls 22 has an abutting portion 222 and a pivot 221, wherein the pawls 22 are pivotally connected to the mounted portion 212 via the pivot 221. When a rotation speed of the rotating member 20 is greater than or equal to a predetermined rotation speed, the abutting portions 222 of the pawls 22 pivot from a first position to a second position. When a rotation speed of the rotating member 20 is smaller than the predetermined rotation speed, the abutting portion 222 of each of the pawls 22 does not constantly abut against one of a plurality of abutted portions 302 of the braking device 30, so that the pawl 22 is in an unlocked state.

The braking device 30 has a protrusion 31 and is engaged with the first arm 12 via the protrusion 31, wherein the braking device 30 is located between the first arm 12 and the mounted portion 212 of the rotating member 20. When the pawls 22 are in the second position and rotate as a rotation of the rotating member 20, the abutting portions 222 of the pawls 22 move along a rotational pathway. The braking device 30 further includes the plurality of abutted portions 302 which are disposed on the rotational pathway of the abutting portions 22, so that the abutted portions 302 can be abutted by the abutting portion to stop the rotation of the rotating member 20.

As illustrated in FIG. 3, in the current embodiment, the pawls 22 includes two pawls 22*a*, 22*b*. Each of pawls 22*a*, 22*b* further includes a body portion 224 and the abutting portion 222, wherein the body portion 224 is located at a side of the pivot 221, and the abutting portion 222 is located at another side of the pivot 221 opposite to the side being disposed with the body portion 224. In the current embodiment, when each of the pawls 22*a*, 22*b* is normal and is not blocked by the abutted portion 302, each of the pawls 22*a*, 22*b* tilts to the body portion.

When the rotation speed of the rotating member 20 is smaller than the predetermined rotation speed, the body portion 224 of each of the pawls 22*a*, 22*b* touches a portion of a periphery of the plurality of abutted portions 302 and swings as an outer diameter of the abutted portion 302 of the braking device 30 changes.

The pawls 22*a*, 22*b* are symmetrically disposed on a surface of the mounted portion 212, so that the pawls 22*a*, 22*b* are symmetrical to each other about a center of the rotating member 20. In practice, a number of the pawls 22 could more than two, and the pawls 22 are arranged at an equal interval around the center of the rotating member 20. In such way, the pawls 22 could form a regular polygon and the center of the rotating member 20 is a center of gravity of the regular polygon.

In the current embodiment, a main body of each of the pawls 22*a*, 22*b* includes the body portion 224 and the abutting portion 222, and each of the pawls 22*a*, 22*b* includes an elastic member 226, wherein an end of the elastic member 226 is fixed to the main body of each of the pawls 22*a*, 22*b*, and another end of the elastic member 226 is fixed to the mounted portion 212 of the rotating member 20. Additionally, in the current embodiment, the end of the elastic member 226 is fixed to the body portion 224 of the main body of each of the pawls 22*a*, 22*b*, and the another end of the elastic member 226 is fixed to the mounted portion 212 of the rotating member 20, so that the body portion 224 is located between the pivot 221 and the elastic member 226. When the rotation speed of the rotating member 20 is smaller than the predetermined rotation speed, the elastic member 226 makes the body portion 224 of each of the pawls 22*a*, 22*b* touches a portion of the periphery of the abutted portions 302, and the body portion 224 swings as the outer diameter of the abutted portions 302 of the braking device 30 changes.

Additionally, when each of the pawls 22*a*, 22*b* swings as the diameter of the abutted portions 302 changes, the elastic member 226 provides each of the pawls 22*a*, 22*b* a resilience for swinging back, thereby avoiding the body portion 224 of each of the pawls 22*a*, 22*b* to repeatedly hit the periphery of the abutted portions 302 of the braking device 30, leading to the damage of the fall arrest device 1. The elastic member 226 provides an upward tension to the body portion 224 of the pawl 22*b* which is located at a lower part of the rotating member 20 for preventing the body portion 224 of the pawl 22*b* from dropping down to make the abutting portion 222 of the pawl 22*b* abuts against the abutted portion 302 of the braking device 30, thereby leading to an abnormal stop when the rotation speed of the rotating member 20 is smaller than the predetermined rotation speed.

As illustrated in FIG. 3 to FIG. 9, when the rotating member 20 rotates, one of the pawls 22*a*, 22*b* is located above the other one of the pawls 22*a*, 22*b* in a longitudinal direction of the fall arrest device 1, wherein the body portion 224 of the pawl 22*a* located above constantly touches a portion of the periphery of the abutted portions 302 and swings as the outer diameter of the abutted portions 302 changes. As illustrated in FIG. 3, in the longitudinal direction of the fall arrest device 1, the pawl 22*a* is defined as high, and the pawl 22*b* is defined as low. As illustrated in FIG. 4 to FIG. 9, a center of gravity G of each of the pawls 22*a*, 22*b* is located at the body portion 224, so that normally, the body portion 224 of the pawl 22*a* located at an upper part of the rotating member 20 could constantly contact with a portion of the periphery of the abutted portions 302 and swing as the outer diameter of the abutted portions 302 changes. When the body portion 224 of the pawl 22*b* located at the lower part of the rotating member 20 swings as the outer diameter of the abutted portions 302 changes, the body portion 224 of the pawl 22*b* which is lower may slightly swing downwardly.

Figure 4:
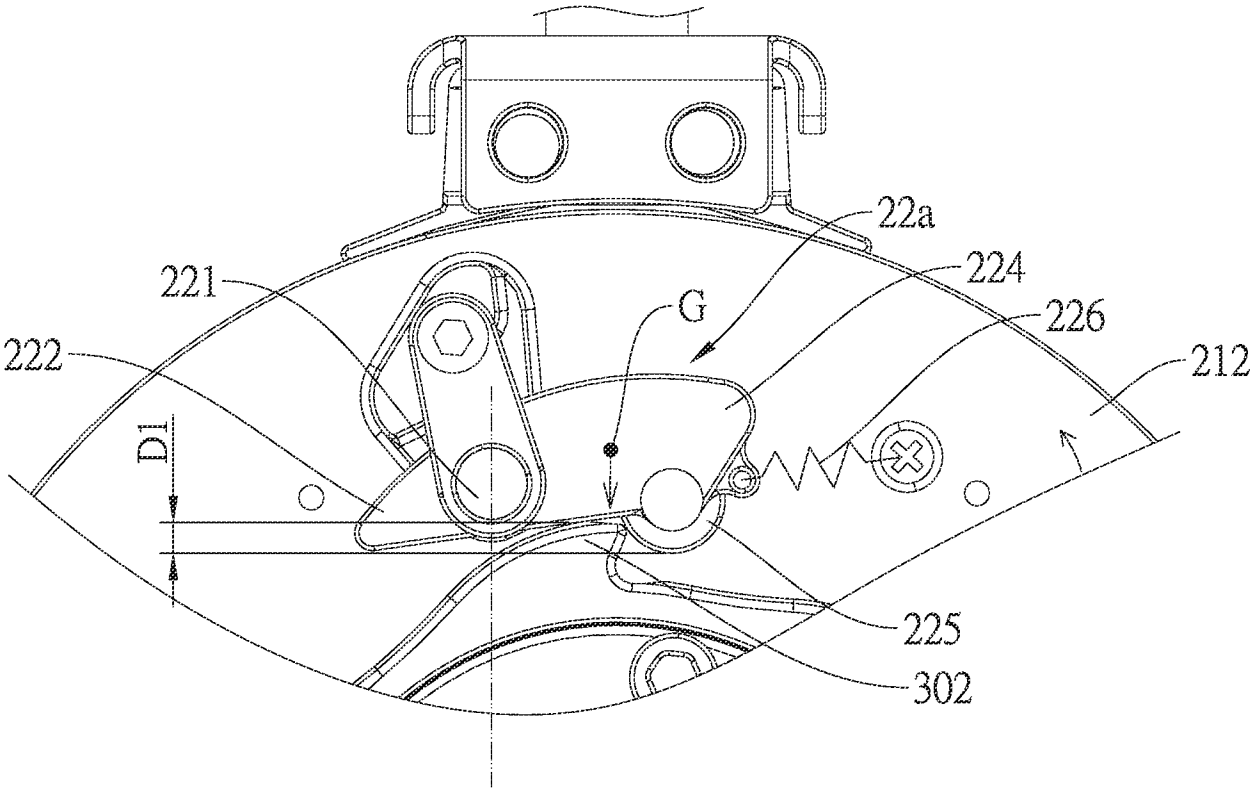
FIG. 4 is a partially enlarged view of the upper pawl on the main body of the fall arrest device shown in FIG. 3, wherein the body portion of the upper pawl touches the periphery of the braking device.
Figure 7:
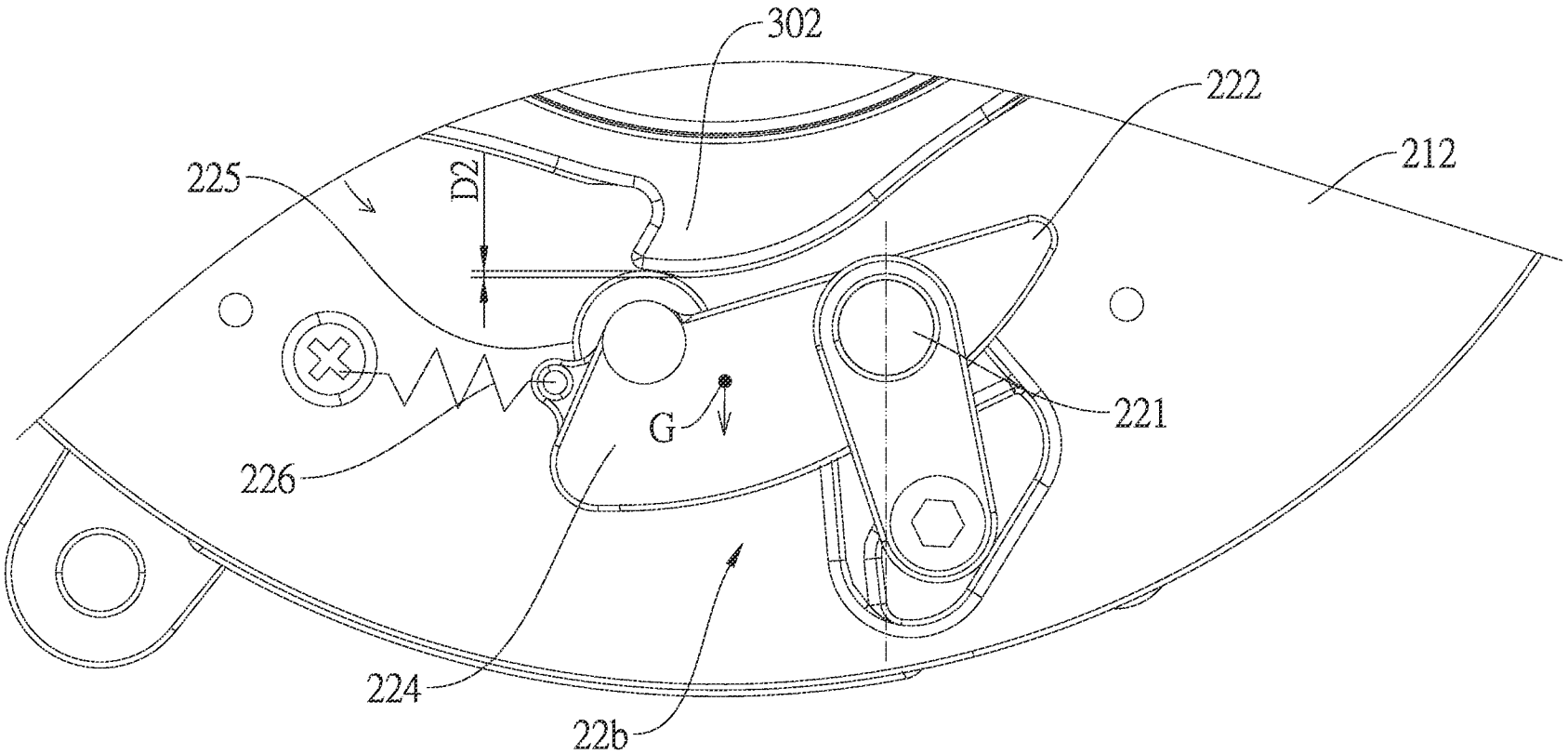
FIG. 7 is a partially enlarged view of the lower pawl on the main body of the fall arrest device shown in FIG. 3, wherein the body portion of the lower pawl touches the periphery of the braking device.
Figure 8:
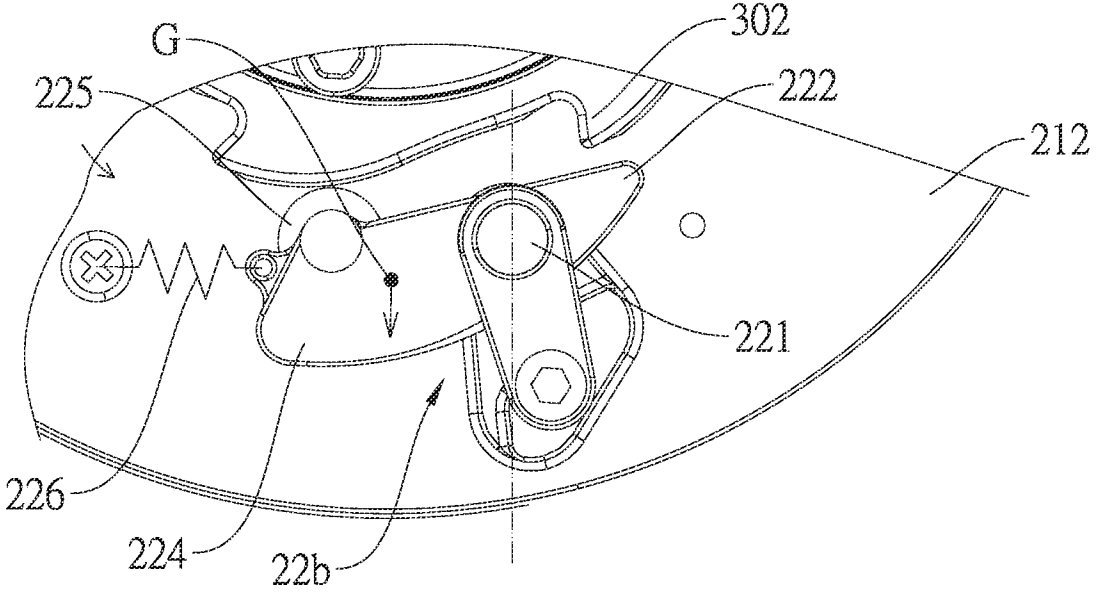
FIG. 8 is a partially enlarged view of the lower pawl on the main body of the fall arrest device shown in FIG. 4, wherein the body portion of the lower pawl continuously touches the periphery of the braking device when the braking device rotates; and, FIG. 9 is a partially enlarged view of the lower pawl on the main body of the fall arrest device shown in FIG. 8, wherein the body portion of the lower pawl continuously touches the periphery of the braking device when the braking device rotates.
Figure 9:
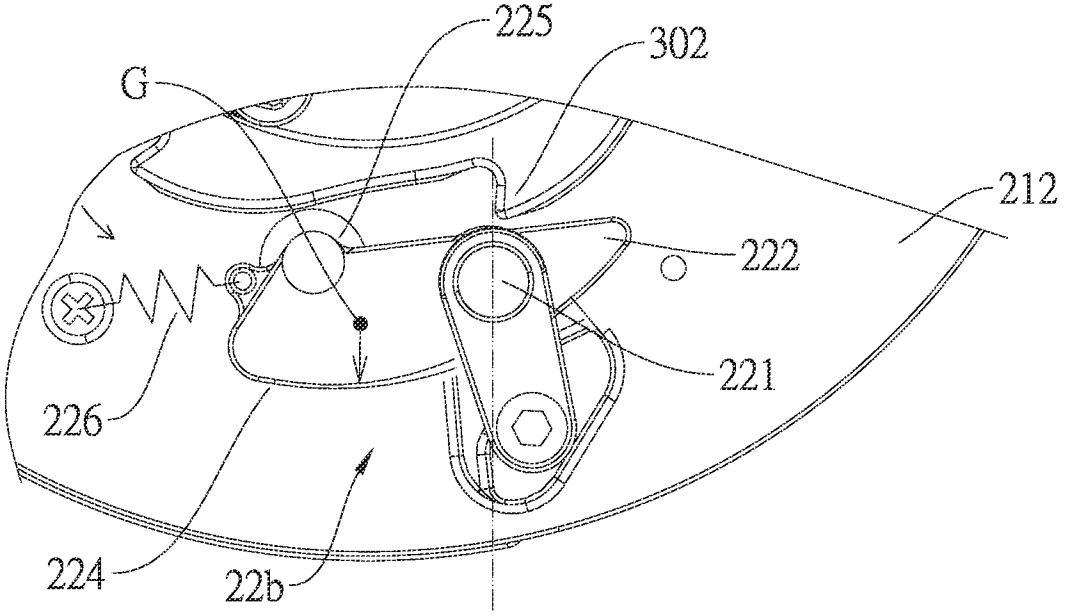

As illustrated in FIG. 4 and FIG. 7, when the rotation speed of the rotating member 20 is smaller than the predetermined rotation speed, the body portion 224 of the pawl 22*a* located above constantly touches a portion of the periphery of the abutted portions 302. A perpendicular distance between a highest point of the periphery of the abutted portions 302 and a point of the body portion 224 of the pawl 22*a* where it is closest to the protrusion 31 is defined as a first distance D1. When the body portion 224 of the pawl 22*b* located lower touches another portion of the periphery of the abutted portion, a perpendicular distance between a lowest point of the abutted portions 302 and a point of the body portion 224 of the pawl 22*b* where it is closest to the protrusion 31 is defined as a second distance D2. The first distance D1 is greater than the second distance D2

Figure 5:
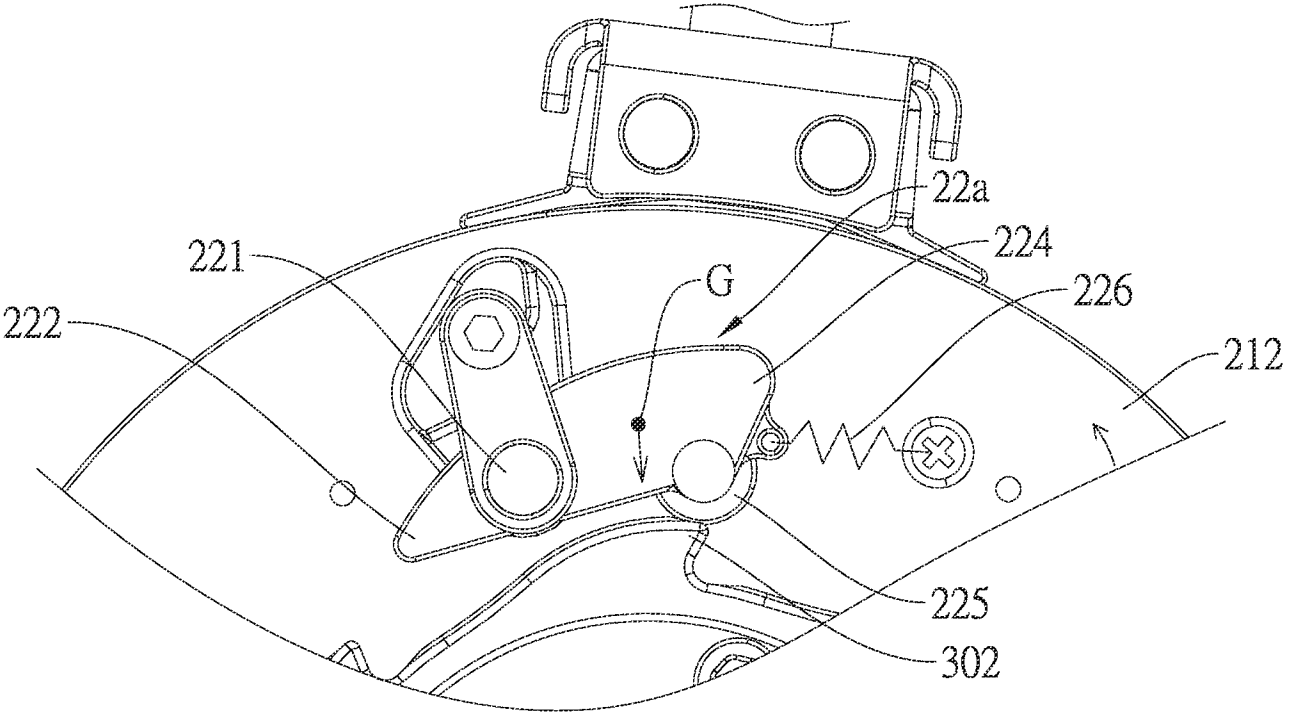
FIG. 5 is a partially enlarged view of the upper pawl on the main body of the fall arrest device shown in FIG. 4, wherein the body portion of the upper pawl continuously contacts with the periphery of the braking device when the braking device rotates.
Figure 6:
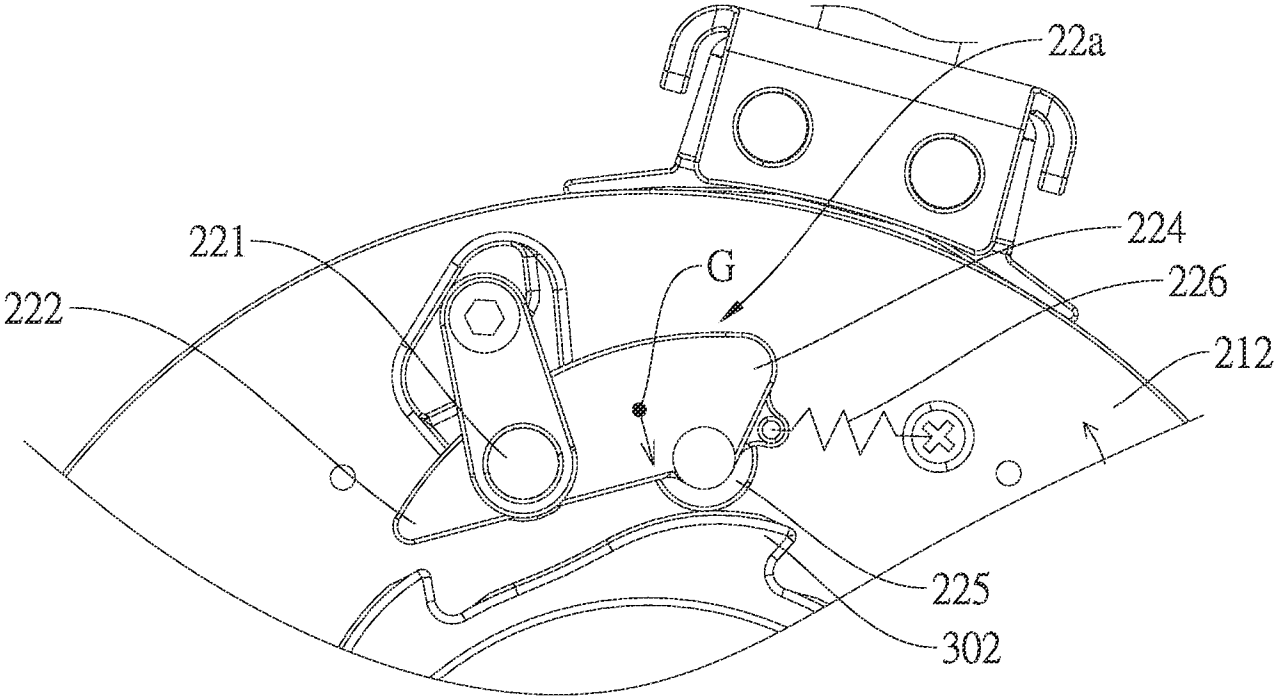
FIG. 6 is a partially enlarged view of the upper pawl on the main body of the fall arrest device shown in FIG. 5, wherein the body portion of the upper pawl continuously touches the periphery of the braking device when the braking device rotates.

Therefore, when the rotation speed of the rotating member 20 is smaller than the predetermined rotation speed, the body portion 224 of the pawl 22*a* located above hits one of the abutted portions 302 to tilt in a direction away from the protrusion 31 (namely upwardly) and to resist a gravitational force of the body portion 224 in a downward direction. Compare to the pawl 22*b* located lower, a movement of the body portion 224 of the pawl 22*a* located higher generated by hitting one of the abutted portions 302 is greater than a movement of the body portion 224 of the pawl 22*b* located lower generated by hitting one of the abutted portion 302, as illustrated in FIG. 4 to FIG. 6.

In such way, in the current embodiment, the fall arrest device 1 could avoid malfunction resulting from dust and sand stuck in the pawls 22*a*, 22*b* to enhance a safety and a reliability of the fall arrest device 1. Additionally, in a normal situation, the body portion 224 of the pawl 22*a* located above touches a portion of the periphery of the abutted portions 302 and swings as an outer diameter of the portion of the abutted portions 302 of the braking device 30 changes. The body portion 224 of the pawl 22*b* located below touches another portion of the periphery of the abutted portions 302 and swings as an outer diameter of the another portion of the abutted portions 302 of the braking device 30 changes. When the rotation speed of the rotating member 20 is greater than or equal to the predetermined rotation speed, the body portion 224 of the pawl 22*a* located above collides a portion of the periphery of the abutted portions 302 to tilt in the direction away from the protrusion 31 and to resist the gravitational force of the body portion 224 in a downward direction. At the same time, a force that makes the body portion 224 of the pawl 22*a* located above tilt in the direction away from the protrusion 31 and a centrifugal force of the rotating member 20 are in the same direction, and a sum of the force that makes the pawl 22*a* tilt and the centrifugal force is greater than the resilience provided by the elastic member 226 to the body portion 224 of the pawl 22*a*, thereby leading the body portion 224 of the pawl 22*a* located above to pop up. At this time, the abutting portion 222 of the pawl 22*a* located above is moved from the first position to the second position and abuts against one of the abutted portions 302 to stop the rotation of the rotating member 20.

On the other hands, the body portion 224 of the pawl 22*b* located below is pulled by a gravitational force which is in the same direction with the centrifugal force of the rotating member 20, and a sum of the gravitational force and the centrifugal force is greater than the resilience provided by the elastic member 226, thereby making the body portion 224 of the pawl 22*b* below pop up. At this time, the abutting portion 222 of the pawl 22*b* below abuts against one of the abutted portions 302 of the braking device 30 to stop the rotation of the rotating member 20. With such design, an abutment between the pawls 22*a*, 22*b* and the abutted portions 302 of the braking device 30 could be ensured to perform a braking or stopping function, thereby avoiding a user to fall and to endanger life.

In the current embodiment, the body portion 224 of each of the pawls 22*a*, 22*b* includes a roller 225, wherein the roller 225 is used to touch the periphery of the abutted portions 302 to make the body portion 224 smoothly move along the periphery of the abutted portions 302, thereby preventing the body portion 224 of each of the pawl 22*a*, 22*b* from repeatedly hitting the periphery of the abutted portions 302 of the braking device 30 to damage the fall arrest device 1.

With such design, the user could pull the safety belt of the fall arrest device before use, and the oscillations of the pawls caused by pivoting could inform the user that the pawl is not stuck and could function normally. The fall arrest device provided by the present invention includes the plurality of pawls. When the pawls rotate to the different positions, such as the highest point or the lowest point, the force that make the pawls tilt or the gravitational force of the body portion could be in the same direction with the direction of the centrifugal force to jointly lead the pawls to tilt, so that each of the pawls could indeed engage the braking device to stop the rotation of the rotating member, thereby stopping or decelerating speed of falling to save the life of the user.

It must be pointed out that the embodiment described above is only a preferred embodiment of the present invention. All equivalent structures which employ the concepts disclosed in this specification and the appended claims should fall within the scope of the present invention.

What is claimed is:

1. A fall arrest device comprising:

a frame having a first arm and a second arm;

a rotating member pivotally connected to the frame and located between the first arm and the second arm, wherein the rotating member comprises a main body and a plurality of pawls; the main body of the rotating member has a mounted portion and a receiving portion; the receiving portion is adapted to be winded up by a flexible long strip body; each of the plurality of pawls has an abutting portion and a pivot, wherein the plurality of pawls are pivotally connected to the mounted portion via the pivot; when a rotation speed of the rotating member is greater than or equal to a predetermined rotation speed, the abutting portions of the plurality of pawls pivot from a first position to a second position; when the plurality of pawls are in the second position and rotate as the rotating member rotates, the abutting portions of the plurality of pawls move along a rotational pathway;

a braking device having a protrusion and engaged with the first arm via the protrusion, wherein the braking device is located between the first arm and the mounted portion of the rotating member; the braking device further comprises a plurality of abutted portions which are disposed on the rotational pathway of the abutting portions in the second position, so that the abutted portions could be abutted by the abutting portion to stop a rotation of the rotating member;

wherein each of the plurality of pawls further comprises a body portion which is located at a side of the pivot, and the abutting portion is located at another side of the pivot which is opposite to the side with the body portion; when the rotation speed of the rotating member is smaller than the predetermined rotation speed, the body portion of each of the plurality of pawls touches a portion of a periphery of the plurality of abutted portions and swings as an outer diameter of the abutted portions of the braking device changes;

wherein, when the rotating member rotates, the plurality of pawls rotate with the rotation of the rotating member; and wherein the plurality of abutted portions of the braking device are fixed.

2. The fall arrest device as claimed in claim 1, wherein when each of the plurality of pawls is normal and is not blocked by the abutted portions, each of the plurality of pawls tilts to the body portion.

3. The fall arrest device as claimed in claim 2, wherein when the rotating member rotates, one of the plurality of pawls is located above the pawl(s) other than the one in a longitudinal direction of the fall arrest device; when the rotation speed of the rotating member is smaller than the predetermined rotation speed, the body portion of the one of the plurality of pawls located above constantly touches a portion of the periphery of the abutted portions, wherein a perpendicular distance between a highest point of the periphery of the abutted portions and a point of the body portion one of the plurality of pawls located above, where is closest to the protrusion, is defined as a first distance; when the body portion of one of the plurality of pawls located below touches another portion of the periphery of the abutted portion, a perpendicular distance between a lowest point of the abutted portions and a point of the body portion of the one of the pawl located below, where is closest to the protrusion, is defined as a second distance; the first distance is greater than the second distance.

4. The fall arrest device as claimed in claim 3, wherein when the rotation speed of the rotating member is greater than or equal to the predetermined rotation speed, the body portion of the one of the plurality of pawls located above hits a portion of the periphery of the abutted portions to tilt in the direction away from the protrusion and is swung outwardly due to a centrifugal force generated by the rotation of the rotating member, so that the abutting portion of the one of the plurality of pawls located above pivots from the first position to the second position to abut against one of the abutted portions; at the same time, the body portion of the one of the pawls located below is pulled by a gravitational force to slightly move down and is swung outwardly due to a centrifugal force generated by the rotation of the rotating member, so that the abutting portion of the one of the plurality of pawls located below pivots from the first position to the second position to abut against another one of the abutted portions.

5. The fall arrest device as claimed in claim 1, wherein the body portion of each of the plurality of pawls comprises a roller that is used to touch the periphery of the abutted portions.

6. The fall arrest device as claimed in claim 1, wherein each of the plurality of pawls comprises an elastic member; an end of the elastic member is fixed to a pawl main body of each of the pawls, and another end of the elastic member is fixed to the mounted portion of the rotating member.

7. The fall arrest device as claimed in claim 1, wherein a number of the plurality of pawls is two; the two pawls are disposed on a surface of the mounted portion and are symmetrical to each other about a center of the rotating member.

* * * * *